United States Patent [19]

Landis et al.

[11] 4,451,226

[45] May 29, 1984

[54] FLAME SAFEGUARD SEQUENCER HAVING SAFE START CHECK

[75] Inventors: William R. Landis, Bloomington; Paul B. Patton, Columbia Heights, both of Minn.

[73] Assignee: Honeywell Inc., Minneapolis, Minn.

[21] Appl. No.: 456,952

[22] Filed: Jan. 10, 1983

[51] Int. Cl.³ ..... F23N 5/24

[52] U.S. Cl. ..... 431/15; 431/18; 431/24; 431/26; 431/29; 431/69; 340/577

[58] Field of Search ..... 431/13, 3, 14, 15, 24, 431/26, 29, 18, 45, 69; 371/62; 340/577

[56] References Cited

U.S. PATENT DOCUMENTS

| | | | |
|---|---|---|---|
| 3,064,719 | 11/1962 | Graves | 431/26 |
| 3,082,813 | 3/1963 | Hamelink | 431/26 |
| 3,143,162 | 8/1964 | Graves et al. | 431/26 |
| 3,644,748 | 2/1972 | Lord | 431/26 X |
| 3,814,569 | 6/1974 | Jacobsz | 431/29 |
| 4,078,878 | 3/1978 | Barbour et al. | 431/30 X |
| 4,101,258 | 7/1978 | Jacobsz | 431/26 |
| 4,137,035 | 1/1979 | Cade | 431/78 |
| 4,192,641 | 3/1980 | Nakagawa et al. | 431/15 |
| 4,399,537 | 8/1963 | Jones | 431/24 X |

*Primary Examiner*—Samuel Scott
*Assistant Examiner*—Margaret A. Focarino
*Attorney, Agent, or Firm*—Alfred N. Feldman

[57] ABSTRACT

A purge time hold circuit is provided in a flame safeguard sequencer to in turn provide a safe start check of a burner control system. If a flame is indicated during a prepurge period, the purge time hold means will reset to a zero status and the timer will hold until the signal clears itself. If the flame signal does not clear itself within a preset time, a safety shut down will be commanded.

4 Claims, 2 Drawing Figures

FLAME SAFEGUARD SEQUENCER HAVING SAFE START CHECK

BACKGROUND OF THE INVENTION

In the operation of various types of burners, it is common practice for the system to employ a flame sensor for the detection of a proper burner flame. In addition to using the sensor for monitoring the flame when one should exist, the flame sensing means can be used to monitor the burner to detect the presence of a flame when none should exist.

Typically, in the operation of flame safeguard equipment, a flame sensor monitors the burner at start up and/or during the purge period to make sure that no flame exists, when none should exist. This type of sequence is often referred to as a safe start check. The safe start check helps monitor the burner, and at the same time, provides some protection against inadvertent failures in the flame safeguard sequencer or its flame detecting apparatus. Any indication of a flame when none should exist must be considered a serious type of failure and the system should react to provide a safe mode of operation. If a flame actually exists, the burner should be shut down and locked out. If a false indication of a flame exists, a shut down should again occur, but in this case it should occur in order to provide a means of indication that the flame detecting system requires maintenance or repair.

Typically in a system with a safe start check, if the system detects a fault or unwanted flame, it can fail to respond to a call for heat if the fault is detected during the burner standby period, reset the purge timer if the fault is detected during prepurge, or shut down and lock out if the fault is detected during prepurge. These types of operation can occur even on a momentary presence of a flame signal that might be one that would dissipate, and not be detectable when the unit is serviced. Also, many times this type of a fault is not noticed until a building heated by the burner has started to fall in temperature. Ordinarily this is more of an inconvenience than anything else. If the burner system is being used in process control, the failure can be very serious, as the temperature within the process being controlled could cause faulty process operation before the fault is detected and the process shut down.

SUMMARY OF THE INVENTION

The present invention is directed to a safe start check which alters the time sequence of a prepurge portion of a burner operation in the event that a flame signal is detected when none should be present. This flame signal could be an actual flame or could be a defect in the sensor or its related amplifier circuitry. In the present invention, the purge timer portion of a flame safeguard sequencer is reset to a zero time status and the timer is placed on hold until the false or unwanted signal clears itself. The problem is annunciated with a hold code during this period. If the unwanted flame signal does not clear itself within, say 30 seconds, a safety shut down will be commanded for the system. In this way an inadvertent or momentary false flame signal does not abort the operation of the burner at its start up, but allows the burner to wait an appropriate period of time to determine whether the conditions have changed to allow for a safe start up. If a safe start up is not provided for within a short period of time, the system will shut down and typically will annunciate the shut down operation. This annunciator function also can include a means to display what type of a fault occurred and what time during the sequence the fault in fact happened.

DESCRIPTION OF THE PREFERRED EMBODIMENT

Figure 1:
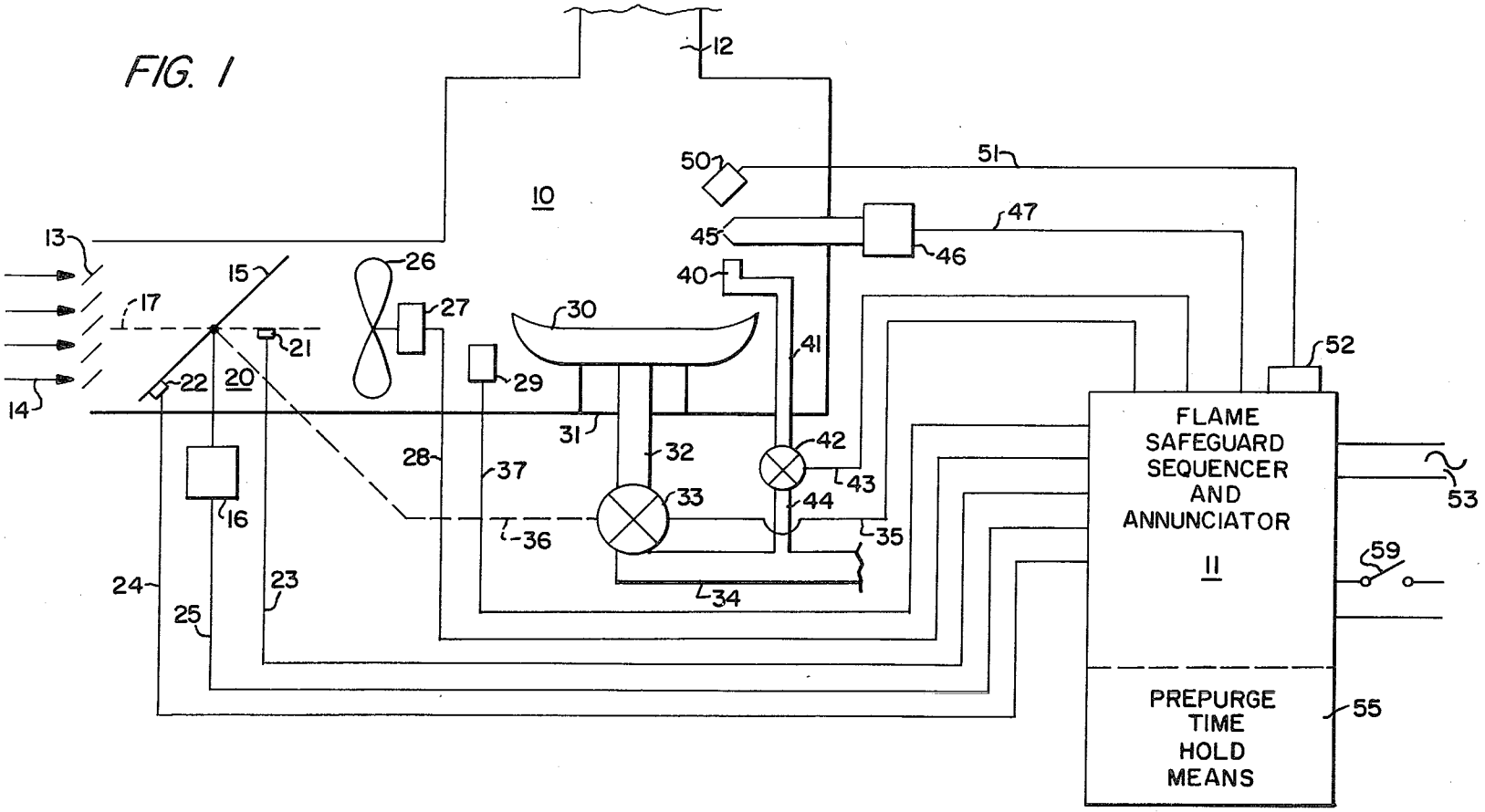
FIG. 1 is a schematic representation of a fuel burner including the novel sequencer.

In FIG. 1 there is schematically disclosed a fuel burner 10 which is operated under the control of a flame safeguard sequencer 11. The fuel burner 10 could be any type of burner such as a gas fired burner, an oil fired burner, or a burner which utilizes both fuels. The flame sequencer 11 typically would operate the fuel burner 10 in any conventional sequence such, as example, a prepurge, trial for pilot or trial for ignition, trial for main flame, main flame run or modulation, and a postpurge sequence. The sequencer 11 also would include an annunciator and/or a fault code indicator. The fuel burner is disclosed as having a stack 12 and an air inlet 13 with air flow schematically indicated at 14. The air inlet 13 is regulated by a damper 15 that is driven by a damper drive motor means 16. The damper 15 is shown in a semiclosed position which will be referred to as a low fire position. A second position disclosed at 17, with the damper open, will be referred to as a high fire position.

A high fire and low fire switch means is disclosed at 20 and includes a pair of switches 21 and 22. The switch 21 is activated by the damper 15 when it reaches the position shown at 17. The switch 22 is activated by the damper 15 in the position shown. Both of the switches 21 and 22 are normally open electrical switches which close to change an electrical state for the flame safeguard sequencer 11 to indicate the proper operation of the damper 15 between the position shown and the position 14. The switch 21 is connected by conductors 23 to the flame safeguard sequencer, while the switch 22 is connected by the conductors 24 to the flame safeguard sequencer 11. The damper drive motor means 16 is connected by conductors 25 to the flame safeguard sequencer 11 so that the motor means 16 can be operated to drive the damper 15 to in turn properly actuate the switches 21 and 22.

The fuel burner 10 further has a fan or air souce 26 driven by a conventional motor 27 that is connected by conductors 28 to the sequencer 11. An air flow or sail switch 29 is proved to sense the actual flow of air and is connected by conductors 37 to the sequencer 11. The fan 26 provides the burner 10 with an air flow 14 from the inlet 13 to the stack 12 to provide combustion air and to provide a prepurge and postpurge operation of the burner, when required, and is proven by switch 29.

A burner is schematically disclosed at 30 mounted to the bottom 31 of the fuel burner 10 and supplied by a pipe 32 from a valve 33 connected to a fuel line 34. The valve 33 is connected by electric conductors 35 to the sequencer 11, and also can be connected by a linkage 36 to the damper 15. This is done in order to adjust the flow of fuel through the valve 33 with the position of the damper 15, in addition to controlling the fuel flow through the valve 33 in an off-on manner by electric conductors 35.

A pilot burner 40 is mounted at the main fuel burner 30 and is connected by a pipe 41 to a pilot fuel valve 42 that has electrical connection means or conductors 43 connected to the sequencer 11. The pilot fuel valve 42 is connected by a pipe 44 to the main fuel pipe 34, as would be used in a gas only installation. The particular type of fuel for the main burner 30 and the pilot burner 40 is not material to the present invention, and the presently disclosed arrangement is purely schematic in nature in order to provide an explanation of an operation of the present invention.

The fuel buner 10 is completed by the provision of an ignition source 45 disclosed as a pair of spark electrodes that are connected to a spark generating means 46 that is connected by conductors 47 to the sequencer 11 to receive power and control. Also provided is a flame sensor means 50 that is connected by conductors 51 to a flame sensor amplifier 52. The amplifier 52 can be designed to plug into the flame safeguard sequencer 11. The sequencer 11 is energized from a conventional line source at 53. The flames safeguard sequencer 11 has a normal sequencing portion, an annunciator and a fault code portion, and has a further portion 55 that provides a prepurge time hold means for the burner (which could be a plug in module), as will be described after the description of a flow chart of the sequence of operation of the novel portion of the present unit. The burner 10 is activated upon the operation of a controller 59.

Figure 2:
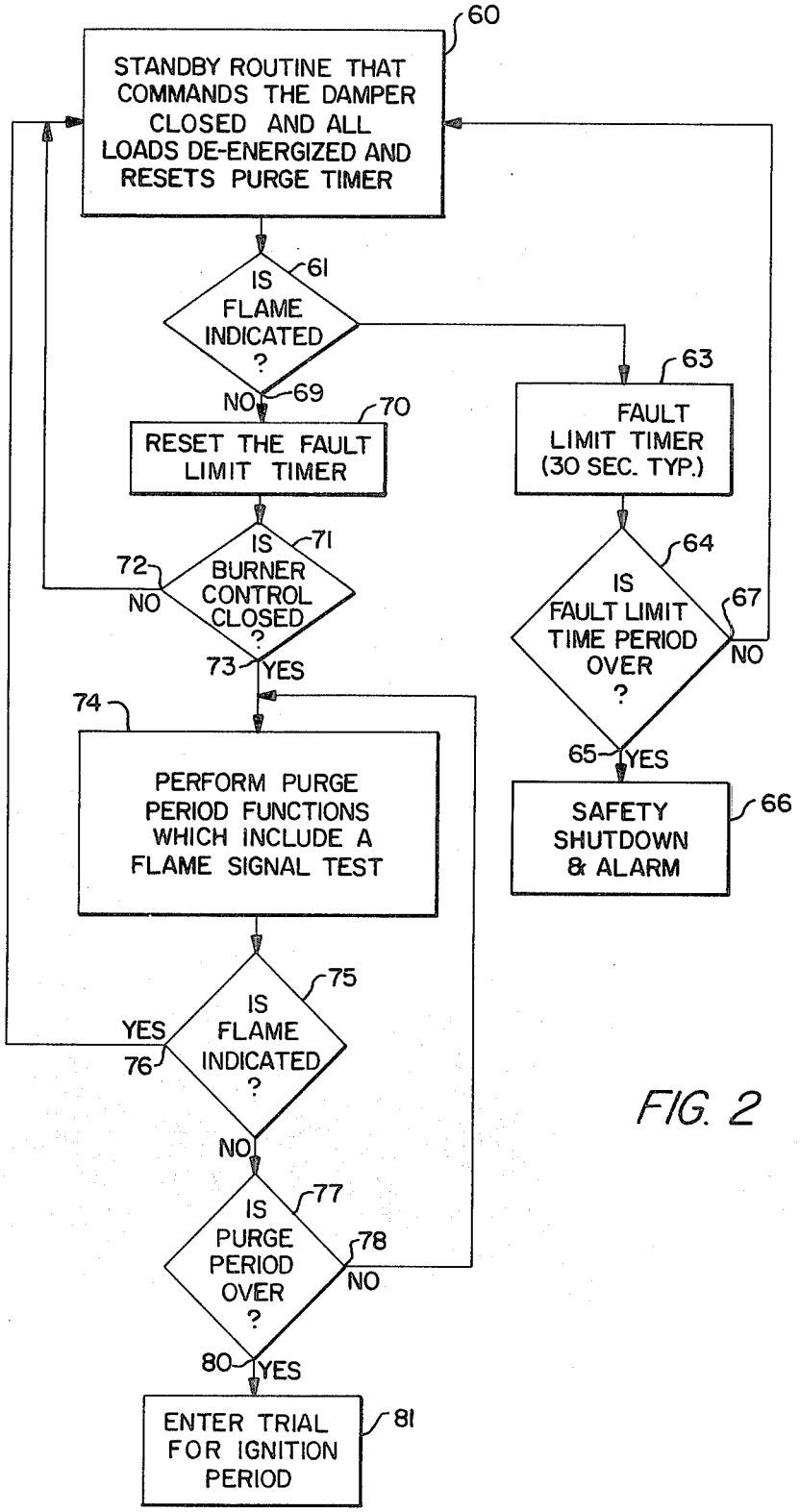
FIG. 2 is a flow chart of the novel portion of operation of the system of FIG. 1.

In FIG. 2 there is disclosed a flow chart of the novel portion of the operation of system of FIG. 1. The flow chart of FIG. 2 basically deals only with the portion of the operation of the system from a standby routine 60 to the system reaching a trial for ignition or trial for pilot portion of the sequence. The standby routine 60 commands the damper 15 to its closed position and all of the loads are deenergized and the purge timer hold means 55 is reset.

The flame safeguard sequencer and annunciator 11 then proceeds at 61 to determine whether a flame is indicated by the flame sensor 50 checking the fuel burner 10. If a flame is indicated, at the output "yes" 62 a fault is determined to exist and an additional time is inserted in the operation of the flame safeguard sequencer 11 by causing a fault limit timer to run at 63. The time inserted is typically 30 seconds. Until the 30 second interval has expired, the system at 64 determines whether the additional time as a fault limit time period is over. If the time interval has expired, a "yes" is generated at 65 and the system goes into a safety shut down and alarm 66 by operating the annunciator of the flame safeguard sequencer and annunciator 11. This feature permits some false flame signal time and then calls attention to a continuous problem. If the fault limit time period is not over, as a "no" at 67, the routine closes back to the standby routine and starts once again.

As soon as the system shows the absence of a flame as a "no" at 69, the system resets the fault limit timer at 70 and progresses to determine whether the controller 59 is closed at 71. If a "no" exists at 72 the system tries once again by going back to the standby routine 60. If the burner control 59 is closed a "yes" is generated at 73, and the system goes on to perform a prepurge function at 74. The purge function also includes a further test for a flame signal at 75. If a "yes" exists at 76 the system recycles once again. If no flame is present at 75 at the system goes on to the purge at 77. If the purge is not over as indicated at 78 by a "no", the purge continues by recycling into the purge function 74. If the purge is over a "yes" is generated at 80 and the system enters a trial for ignition period 81. The system then continues in a normal operating mode for the flame safeguard sequencer and annunciator 11.

The novel extended safe start check accomplished by the flame safeguard sequencer and annunciator means 11, along with the prepurge time hold means 55, checks for a flame during the prepurge period. If a flame is sensed the purge time hold means 55 will cause the system to reset to its zero time status and the timer will hold until the signal clears itself. If the flame signal does not clear itself within the specified time, typically 30 seconds, a safety shut down will be commanded. The specific routine disclosed accomplishes an energy saving, a superior and more even control of temperature, and is capable of locating an intermittent faulty flame sensor, but the specific routine can be readily altered for various types of burner installations. As such, the flame safeguard sequencer and annunciator 11 and its purge time hold means 55 can be configured in a number of different ways. The specific configuration of the flame safeguard sequencer and annunciator, along with the purge time hold means 55, is limited only by the scope of the appended claims.

The embodiments of the invention in which an exclusive property or right is claimed are defined as follows:

1. A flame safeguard sequencer for the control of a fuel burner upon the operation of controller means with said fuel burner having damper means, ignition means, fuel supply means, and flame sensor means, including: a flame safeguard sequencer connected to said damper means, said ignition means, said fuel supply means, and said flame sensor means to sequentially operate said means to properly purge, ignite and operate said fuel burner in a predetermined timed sequence upon operation of said controller means; said flame sensor means energized by said sequencer to monitor said burner for the presence or absence of flame upon said controller means operating to initiate the operation of said fuel burner; and said sequencer including prepurge time hold means to reset and hold said predetermined timed sequence for said fuel burner operation in the event that said flame sensor means senses the presence of a flame during a standby period and said purge portion of said sequence of operation when no flame should be present; said prepurge time hold means further shutting said burner off in the event an unwanted flame signal exists for a predetermined time established by said prepurge time hold means.

2. A flame safeguard sequencer as described in claim 1 wherein the said flame safeguard sequencer includes a microcomputer to operate said fuel burner in said predetermined time sequence.

3. A flame safeguard sequencer as described in claim 2 wherein said prepurge time hold means is included in a plug in module which is plugged into said sequencer to operate with said microcomputer to provide a predetermined time sequence.

4. A flame safeguard sequencer as described in claim 3 wherein said flame safeguard sequencer further includes annunciator means to display events in the operation of said fuel burner; said annunciator means retaining an indication of the operation of said purge timer hold means to aid in the service of said flame safeguard sequencer means in the event of an improper flame signal being detected by said sequencer.

* * * * *